United States Patent [19]

Fisher

[11] Patent Number: 4,937,939

[45] Date of Patent: Jul. 3, 1990

[54] REMOTEDLY OPERATED CHIMNEY CHISEL

[76] Inventor: Francis J. Fisher, 82 Brooks Cove Rd., Candler, N.C. 28715

[21] Appl. No.: 319,481

[22] Filed: Mar. 6, 1989

Related U.S. Application Data

[63] Continuation of Ser. No. 157,581, Feb. 18, 1987, abandoned.

[51] Int. Cl.[5] ..... B27G 17/04

[52] U.S. Cl. ..... 30/167; 15/242

[58] Field of Search ..... 30/167; 15/242, 243, 15/249, 104.03, 104.05, 236.01, 236.04; 134/8

[56] References Cited

U.S. PATENT DOCUMENTS

| | | | |
|---|---|---|---|
| 1,408,472 | 3/1922 | Rohder | 15/242 |
| 2,089,245 | 8/1937 | Barron | 15/236 R |
| 2,910,771 | 11/1959 | Farmer | 30/167 |
| 4,310,940 | 1/1982 | Moore | 15/236 R |

FOREIGN PATENT DOCUMENTS

| | | | |
|---|---|---|---|
| 734862 | 8/1955 | United Kingdom | 15/242 |

*Primary Examiner*—Frederick R. Schmidt
*Assistant Examiner*—M. Rachuba

[57] ABSTRACT

A chisel 1, 2, for removing hard deposits 29 inside a chimney 14, which is braced against one wall 24 to exert a chiseling force on the opposite wall 23. The chisel 1, 2 is sharp on one end 22 and is manipulated by a pushing handle 6 and a pulling handle 4. The chisel 1, 2 is longer than the inside width 26 of the chimney 14 so that a pushing force 19 and a pulling force 20 causes the sharp end 22 to dig into the deposits 29. By exerting slightly more pushing force 19 than pulling force 20 the chisel 1, 2 is made to move along the walls 23, 24 chiseling deposits 29 off as it goes.

1 Claim, 1 Drawing Sheet

REMOTEDLY OPERATED CHIMNEY CHISEL

This application is a continuation of Ser. No. 157,581, filed 2-18-87, now abandoned.

BACKGROUND

This invention pertains to chimneys serving wood burning fireplaces and stoves and in particular to apparatus for removing hard deposits from such chimneys.

Unfortunately, when wood is burned in fireplaces and in many stoves combustion is not complete. Unburned carbon in the form of black fluffy soot may be formed and deposited in the chimney. Though removing it is a messy job tools are available to do the job well. However volatile compounds can be distilled off the burning wood, pass through the flames without being burned and condense out on the walls of the chimney. This condensate can then become baked by the hot gasses passing through the chimney into hard, sometimes glass-like, deposits. These deposits continue to build up as the chimney is used. Some of these deposits peel away from the wall such that they are fairly easy to remove, but much is left fused to the wall and is very difficult to remove. These deposits are flammable. If the fire in the fireplace or stove is allowed to become vigorous enough for the flames to reach into the chimney, the deposits can catch fire. This can quickly become a roaring fire with flames shooting out of the chimney and sparks falling on the roof. Besides the danger of sparks setting the roof on fire, a chimney fire can cause weakening of the chimney, or if it has been weakened already by previous fires or age, can cause cracks that allow fire to reach flammable construction near the chimney. Many homes have suffered fire damage because the chimney was not cleaned or not cleaned thoroughly because the deposits were too hard to be removed with the tools available.

Many prior art devices appear to be directed to cleaning chimneys. The difficulty is to find a device that can produce enough force to penetrate and chisel away hard deposits that are some distance down inside the chimney. A hand-held chisel is effective but only for an arm's length down inside the chimney.

The object of this invention is to provide a remotedly operated apparatus for removing hard deposits located far inside a chimney.

SUMMARY

This invention is an apparatus for removing hard deposits down inside a chimney by an operator standing at the top of the chimney. The apparatus is comprised of a sharp blade attached to a support piece to form a chisel, a pulling handle attached to the chisel near the sharp end and a pushing handle attached to the chisel near the opposite end. The chisel is longer than the inside width of the chimney. When the chisel is placed in a diagonal position inside the chimney with the sharp end down, and with the sharp end touching one wall and the blunt end braced against the opposite wall, a downward chiseling force can be accomplished by pushing down on the blunt end of the chisel while pulling the sharp end upward into the deposits.

BRIEF DESCRIPTION OF THE DRAWINGS

Other objects and advantages of the present invention will become apparent to those skilled in the art as the following description of the preferred embodiments is studied in conjunction with the following drawings in which.

DESCRIPTION OF PREFERRED EMBODIMENTS

Figure 2:
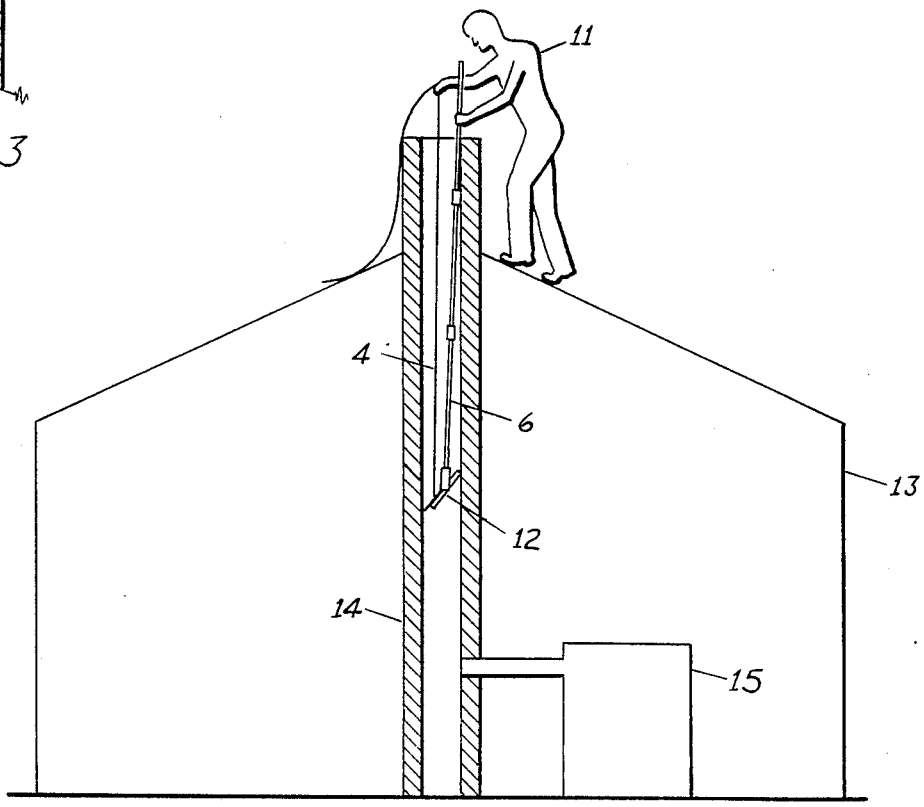
FIG. 2 is a sectional elevation of a chimney showing the invention in use.

FIG. 2 illustrates a sectional view of a typical chimney 14 having an interior 44, an exterior 45, a top 25, a wall 24, and a wall 23 on which there are hard deposits 29. The chimney 14 is a part of a building 13 with a stove 15.

FIG. 2 shows a remotedly operated chimney chisel apparatus 12 positioned in the interior 44 of the chimney 14. The apparatus 12 is held in place by an elongated pulling handle 4 and an elongated rigid pushing handle 6 held by an operator 11 at the top 25 of the chimney 14.

Figure 1:
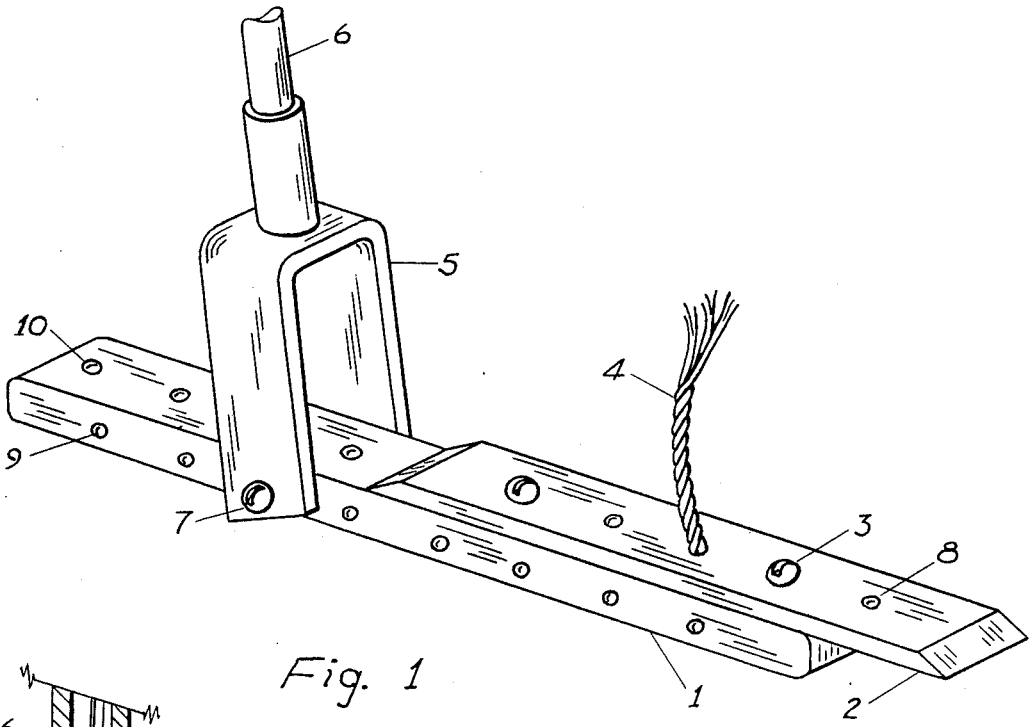
FIG. 1 is a perspective view of the invention.

FIG. 1 illustrates that chimney chisel apparatus 12 has a chisel 1,2 comprised of a support piece 1, blunt on both ends 21,71, to which is fastened, by fasteners 3, a blade 2, sharp on both ends 22,70, with the sharp end 22 of the blade 2 extending beyond the blunt end 71 of the support piece 1. The support piece 1 and the blade 2 are positioned for fastening together to provide a length, from tip of the blunt end 21 to the tip of the sharp end 22, longer than the width 26 of the chimney 14 and long enough to give the desired working angle 28 between the chisel 1,2 and wall 24. The pulling handle 4 is passed through holes 8,10 in the chisel 1,2 and is fastened to the chisel 1,2 by a knot 25. The pushing handle 6 has an end 5 to provide pivotable attachment to support piece 1 and is fastened to the support piece 1 by fastener 7. Holes 9 provide alternate positions of attachment for end 5 to the support piece 1.

The apparatus 12 is lowered, with the sharp end 22 pointed downward, into the chimney 14 with the pushing handle 6 while allowing the pulling handle 4 to follow freely. The chisel 1,2 is then rotated into the working position by holding the pushing handle 6 at a fixed level while pulling upward on the pulling handle 4. With the sharp end 22 touching wall 24 at a lower level and the blunt end 21 touching the opposite wall 23 at a higher level, the chisel 1,2 is in a diagonal position relative to the walls 23,24 because the length of the chisel 1,2 is greater than the inside width 26 of the chimney 14. The pushing force 19 and the pulling force 20 is increased until the sharp end 22 penetrates the deposits 29 on the wall 23 with a force 17 as a bracing force 18 of equal magnitude is exerted against the opposite wall 24. The forces 17,18 are proportional to the forces 19,20 and the angle 28. Downward movement of the chisel 1,2 is accomplished when the pushing force 19 exceeds the pulling force 20 enough to shave away the deposits 29. Short, sharp thrusts produce an impact that is more effective than a steady force.

FIG. 2 illustrates the parts of the pushing handle 6. Sectional piece 27 is threaded on each end 48. Sections are joined by an internally threaded coupling 46. The desired length of the handle is attained by adding or removing sections.

FIG. 1 illustrates blade 2 is sharp on both ends so that, by reversing the ends, end 70 serves as a handy replacement for end 22 when end 22 becomes dull. Chisel 1,2 by being made of two pieces provides a means of changing the length of the chisel 1,2 to provide the working angle desired or for use in a different size chimney. Extra holes 10 and 8 in the support piece 1 and blade 2 provides a means to vary their combined length from end 21 to end 22.

Should the chisel 1,2 become jammed between the walls 23,24, it is released by reversing the force 19 on the pushing handle 6 while relaxing the force 20 on the pulling handle 4.

If chiseling in an upward direction is desired, the position of the handles is reversed, with the pulling handle 4 near the blunt end 21 and the pushing handle 6 near the sharp end 22.

I claim:

1. An apparatus operable from a remote position to exert a chiseling force against one wall inside a chimney by bracing against an opposite wall, the apparatus comprising:

a blade having two ends, both ends beveled to a sharp edge, and the blade having mounting holes for fasteners;

a support piece, having two ends, both ends being blunt, and the support piece having a plurality of adjustment holes for fastening the blade to the support piece;

fastening means for mounting the blade to the support piece, with one sharp end of the blade extending beyond one blunt end of the support piece, to comprise a chisel member sharp on one end and blunt on the other end;

in which the adjustment holes when chosen will adjust the overall length of the chisel member, from the tip of the sharp end to tip of the blunt end, to be longer than the inside width of the chimney;

a pushing handle having a top end held by an operator and a bottom end pivotably attached to the chisel member to apply a force to the chisel member;

a pulling handle having a top end held by an operator and a bottom end pivotably attached to the chisel member to apply a force to the chisel member;

the pulling handle being fastened to the chisel member near the sharp end and the pushing handle being fastened to the chisel member near the blunt end;

so that a further increase of force on one handle while maintaining a lesser force on the other handle causes a movement of the chisel member, the sharp end of the chisel member shaving deposits off the wall as the blunt end of the chisel member slides along the opposite wall, thereby cleaning the chimney.

* * * * *

UNITED STATES PATENT AND TRADEMARK OFFICE

CERTIFICATE OF CORRECTION

PATENT NO. : 4,937,939

DATED : July 3, 1990

INVENTOR(S) : Fisher

Figure 3:
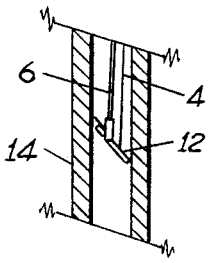
FIG. 3 is a sectional elevation of a chimney showing the invention being lowered into the chimney.

It is certified that error appears in the above-identified patent and that said Letters Patent is hereby corrected as shown below:

Figure 3 should be deleted from the sheet of drawings.

Column 2, lines 6-7, delete "Fig. 3 is a sectional elevation of a chimney showing the invention being lowered into the chimney."

Signed and Sealed this

Twenty-fifth Day of June, 1991

*Attest:*

*Attesting Officer*

HARRY F. MANBECK, JR.

*Commissioner of Patents and Trademarks*